US007770357B2

(12) United States Patent
Yuyama et al.

(10) Patent No.: US 7,770,357 B2
(45) Date of Patent: Aug. 10, 2010

(54) TABLET FILLING DEVICE

(75) Inventors: Hiroyuki Yuyama, Osaka (JP); Naoki Koike, Osaka (JP); Takafumi Imai, Osaka (JP); Hirokazu Chihara, Osaka (JP); Katsunori Yoshina, Osaka (JP); Masayuki Okamoto, Osaka (JP); Yoshihiko Ide, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 140 days.

(21) Appl. No.: 12/066,608

(22) PCT Filed: Sep. 11, 2006

(86) PCT No.: PCT/JP2006/317959

§ 371 (c)(1),
(2), (4) Date: Mar. 12, 2008

(87) PCT Pub. No.: WO2007/032298

PCT Pub. Date: Mar. 22, 2007

(65) Prior Publication Data

US 2009/0235614 A1 Sep. 24, 2009

(30) Foreign Application Priority Data

Sep. 12, 2005 (JP) ..... 2005-263551

(51) Int. Cl.
*B65B 61/00* (2006.01)
*B65B 3/26* (2006.01)

(52) U.S. Cl. ..... 53/167; 53/504; 53/239; 53/249

(58) Field of Classification Search ..... 53/504, 53/167, 237, 239, 247, 249, 251
See application file for complete search history.

(56) References Cited

U.S. PATENT DOCUMENTS 4,252,497 A * 2/1981 Burt ..... 414/627
5,762,116 A * 6/1998 Moore ..... 141/145
5,946,883 A * 9/1999 Yuyama et al. ..... 53/154
6,119,737 A * 9/2000 Yuyama et al. ..... 141/104

(Continued)

FOREIGN PATENT DOCUMENTS

JP 50-137560 10/1975

(Continued)

*Primary Examiner*—Paul R Durand
(74) *Attorney, Agent, or Firm*—Patterson Thuente Christensen Pedersen, P.A.

(57) ABSTRACT

A tablet filling device for supplying a vial container of desired size certainly with no mistake comprising a plurality of containing means containing vial containers by size, a means for taking out a vial container from the containing means based on prescription data, means for carrying a vial container taken out by the container take out means, a means for providing a table to a vial container carried by the carrying means, a means for collecting a vial container in the middle of carriage by the carrying means, a means provided on the carrying passage of the carrying means and detecting the size of a carried vial container, and a control means for judging whether the size of a vial container selected based on the prescription data matches the size of a vial container detected by the container size detection means and collecting the carried vial container by the container collection means if they do not match each other.

3 Claims, 14 Drawing Sheets

U.S. PATENT DOCUMENTS

| | | | | |
|---|---|---|---|---|
| 6,385,943 | B2 | 5/2002 | Yuyama et al. | |
| 6,478,185 | B2 * | 11/2002 | Kodama et al. | 221/6 |
| 6,690,998 | B1 * | 2/2004 | Yuyama | 700/242 |
| 7,048,183 | B2 * | 5/2006 | Coughlin et al. | 235/382 |
| 7,228,198 | B2 * | 6/2007 | Vollm et al. | 700/235 |
| 7,289,879 | B2 * | 10/2007 | William et al. | 700/235 |
| 7,313,898 | B1 * | 1/2008 | Eller et al. | 53/251 |
| 7,461,759 | B2 * | 12/2008 | Guerra | 221/93 |
| 7,549,268 | B2 * | 6/2009 | Kim | 53/411 |
| 2002/0007868 | A1 * | 1/2002 | Kodama et al. | 141/104 |
| 2006/0163271 | A1 | 7/2006 | Hatsuno et al. | |
| 2007/0169437 | A1 | 7/2007 | Yuyama et al. | |

FOREIGN PATENT DOCUMENTS

| | | |
|---|---|---|
| JP | 62-187206 | 8/1987 |
| JP | 10-033636 | 2/1998 |
| JP | 11-070901 | 3/1999 |
| JP | 2002-029501 | 1/2002 |
| JP | 2005-211538 | 8/2005 |
| JP | 2006-204487 | 8/2006 |
| WO | WO 2005/073089 A1 | 8/2005 |

* cited by examiner

TABLET FILLING DEVICE

TECHNICAL FIELD

The present invention relates to a tablet filling device capable of automatically supplying vials of different sizes based on prescription data to be filled with a predetermined quantity of corresponding tablets.

BACKGROUND ART

Conventionally, in a tablet filling device, vials of different sizes are stored in advance in container storage members (for example, buckets), respectively, and the vial of a size allowable to fill tablets prescribed based on prescription data is supplied from the bucket to fill a predetermined quantity of the corresponding tablets in the supplied vial.

DISCLOSURE OF THE INVENTION

Problem to be Solved by the Invention

However, in the conventional tablet filling device, in a case where the vial of a different size is erroneously stored in the bucket, there is a fear of supplying the vial of the different size as it is. In this case, for example, there occurs a problem in that, when the vial of the smaller size is supplied, the filled tablets overflow therefrom.

It is therefore an object of the present invention to provide a tablet filling device capable of positively supplying a vial of a desired size without fail.

Means for Solving the Problem

As means for solving the above-mentioned problem, the present invention provides a tablet filling device including: a plurality of container storage means for storing vials based on sizes; container take-out means for taking out the vial of a size selected based on prescription data from the corresponding container storage means; carrying means for carrying the vial taken out by the container take-out means; tablet supplying means for supplying a tablet to the vial carried by the carrying means; container recovery means in which the vial which is being carried by the carrying means is to be recovered; container size detecting means, which is provided to a carrying path by the carrying means for detecting a size of the vial carried; and control means for determining whether or not the size of the vial selected based on the prescription data matches the size of the vial detected by the container size detecting means, for allowing the tablet to be supplied to the vial by the tablet supplying means when the sizes match each other, and for allowing the vial, which is carried, to be recovered in the container recovery means when the sizes do not match each other.

With this structure, based on the prescription data, the vial is taken out from a corresponding container storage means by the container take-out means and is carried by the carrying means. By the container size detecting means, the size of the carried vial is detected. The control means compares the detected size of the vial with the size of the vial selected based on the prescription data. When the sizes match each other, the predetermined quantity of the tablets are filled into the vial by the tablet supplying means, and a filling operation is ended. On the other hand, when the sizes do not match each other, it is determined that the tablets cannot be filled, and the vial is recovered in the container recovery means. As a result, it is possible to prevent positively such a disadvantage that the vial of an erroneous size is supplied as it is to be filled with the tablets.

Further, as means for solving the above-mentioned problem, the present invention provides a tablet filling device including: a plurality of container storage means for storing vials based on sizes; container take-out means for taking out the vial of a size selected based on prescription data from the corresponding container storage means; carrying means for carrying the vial taken out by the container take-out means; tablet supplying means for supplying a tablet to the vial carried by the carrying means; retraction means for retracting the vial from a carrying path by the carrying means; and control means for determining whether or not the size of the vial selected based on the prescription data matches a size of the vial detected by the container size detecting means, for allowing the tablet to be supplied to the vial by the tablet supplying means when the sizes match each other, and for allowing the vial, which is carried, to be kept on standby by the retraction means until next supply when the sizes do not match each other.

Further, as means for solving the above-mentioned problem, the present invention provides a tablet filling device including: a plurality of container storage means for storing vials based on sizes; container take-out means for taking out the vial of a size selected based on prescription data from the corresponding container storage means; carrying means for carrying the vial taken out by the container take-out means; tablet supplying means for supplying a tablet to the vial carried by the carrying means; control means for determining whether or not the size of the vial selected based on the prescription data matches a size of the vial detected by the container size detecting means, for allowing the tablet to be supplied to the vial by the tablet supplying means when the sizes match each other, and for allowing the vial, which is carried, to be moved upstream of one of the container recovery means, positioned on a most upstream side, to be kept standby until next supply when the sizes do not match each other.

It suffices that the vial has a bottomed cylindrical shape, and the container size detecting means can detect an outer diameter of the vial.

It is preferable that the container size detecting means can also detect a lengthwise dimension of the vial. As a result, it becomes possible to determine sizes of all the vials to be handled.

It is preferable that the carrying means carry the vial in a horizontal position, the container size detecting means have an arm portion, which is rotatable about a support shaft and is capable of abutting an outer peripheral portion of the vial carried by the carrying means, and a sensor for detecting inclination of the arm portion abutted on the outer peripheral portion of the vial, and the control means determine the size of the vial based on the inclination detected by the sensor.

With this structure, it is possible to specify the outer diameter of the vial from a maximum value of the inclination of the arm portion. Further, it is also possible to specify the lengthwise dimension from a transporting speed of the vial and an elapsed time during a period of time from when the inclination of the arm means changes to when the inclination returns to an initial value. Further, it is possible to detect the size of the vial without stopping the carrying of the vial by the carrying means, thereby achieving high working efficiency.

Effect of the Invention

According to the present invention, the container size detecting means is provided to detect the size of the vial carried. Accordingly, it is possible to prevent occurrence of a disadvantage in that the vial of a different size is erroneously carried to be filled with tablets, and the tablets sometimes overflow therefrom.

Best Mode for Carrying Out the Invention

In the following, an embodiment of the present invention will be described with reference to the accompanying drawings.

FIGS. 1 to 4 show a tablet filling device according to this embodiment. The tablet filling device is equipped with, in particular, as shown in FIG. 3, a container supply unit 1, a labeling unit 2, a tablet supply unit 3, a capping unit 4, a carrying means 5, and a take-out unit 6.

The container supply unit 1 is equipped with container storage means (in this case, a plurality of buckets 8) arranged side by side in a lower portion of a front side of a device main body 7 (position along a surface to which a cassette is attached), with the buckets 8 storing vials 9 of different sizes. Each of the buckets 8 can be opened on the front side of the device main body 7 so that the vials 9 can be replenished. The vials 9 stored in each of the buckets 8 are lifted by container take-out means (in this case, lifter 8*a*), and are conveyed to a first carrying means 34.

The labeling unit 2 serves to affix labels to outer peripheral surfaces of the vials 9 carried, and there may be used a well-known one (see, for example, U.S. Pat. No. 5,798,020).

As shown in FIG. 5, the tablet supply unit 3 is equipped with a plurality of tablet supplying means (in this case, tablet feeders 11) fixed to a support panel 10. The tablet feeders 11 store tablets of different kinds.

As shown in FIG. 6, each of the tablet feeders 11 is formed of a tablet cassette 12 accommodating a rotor 13. Through rotation of the rotor 13, it is possible to dispense the stored tablets one by one.

Each of the tablet cassettes 12 is formed of a cassette main body 14 equipped with a cover member 15 that can be opened and closed.

The cassette main body 14 is composed of a cylindrical rotor accommodating portion 16 and a rectangular barrel-shaped tablet storage portion 17 situated thereon. In the tablet storage portion 17, an upper surface (conical surface 13*a*) of the rotor 13 and a side wall form a space capable of storing tablets.

As shown in FIGS. 7 and 8, a part of a back side of the rotor accommodating portion 16 is formed of a detachable first replacement piece 18. A tablet discharge port 19 and a slit 20 are formed in the first replacement piece 18. A partition means 21 is fixed in position in the vicinity of the slit 20, with a brush portion 21*a* thereof protruding into the rotor accommodating portion 16 through the slit 20. By forming the tablet discharge port 19 and the slit 20 by the replaceable first replacement piece 18, it is possible to adjust to different forms of the rotor 13 solely through replacement of the first replacement piece 18, and the remaining portion can be formed in a common structure.

At a center of a bottom surface of the rotor accommodating portion 16, there is formed a through-hole (not shown), and an intermediate gear 22 is rotatably mounted in the vicinity thereof. The intermediate gear 22 is composed of a first gear 22*a* and a second gear 22*b* parallely arranged in an axial direction and integrated with each other.

Further, at the bottom surface of the rotor accommodating portion 16, there is mounted a worm gear 23 in mesh with the second gear 22*b* of the intermediate gear 22. That is, support walls 17*a* and 17*b* protrude at a predetermined interval from the bottom surface of the rotor accommodating portion 16 to rotatably support the worm gear 23. A stopper 24 is provided at one end of the worm gear 23, and a spring 26 is fitted on to a shaft portion 25 protruding therefrom. The spring 26 is situated between the stopper 24 and the support wall 17*b*, and urges the worm gear 23 toward the support wall 17*a* situated on the opposite side. As a result, the worm gear 23 is held in position, with its tooth surface held in press contact with a tooth surface of the second gear 22*b* of the intermediate gear 22. A locking/receiving portion 27 is formed at a forward end of the shaft portion 25. The locking/receiving portion 27 has a cylindrical outer peripheral wall in which a spiral guide groove 28 is formed at two opposing positions. Further, at a terminal end thereof, there is provided a pin holding portion 29 formed through peripheral cutting.

As shown in FIGS. 6 and 8, an upper portion of a back surface of the tablet storage portion 17 is formed by a detachable second replacement piece 30. The second replacement piece 30 is equipped with an escape recess 31, and bearing portions 32 are formed at both ends thereof. The second replacement piece 30 is provided with the escape recess 31 because, from the viewpoint of molding, it is difficult to form in the tablet cassette 12 an inwardly swollen inclined portion for forming the escape recess 31.

On a front side of the tablet containing portion 17, there is provided a grip 80 composed of third, fourth, and fifth replacement pieces 81, 82, and 83, respectively. By grasping the grip 80, it is possible to attach the tablet cassette 12 to the support panel 10 and draw it out.

In this way, the second, third, fourth, and fifth replacement pieces 30, 81, 82, and 83 are molded by separate processes, respectively, and can be attached to the tablet cassette 12 afterwards, thereby making it possible to suppress an increase in the mold cost, etc.

The cover member 15 is formed as a rectangular plate, and is equipped with a shaft portion 15*a* rotatably supported by the bearing portions 32. On an inner side of the shaft portion 25, there is formed a cutout portion 15*b* in correspondence with the escape recess 31. Owing to the escape recess 31 and the cutout portion 15*b*, interference with a discharge path for the tablet cassettes 12, arranged upwardly adjacent thereto, is avoided. As a result, it is possible to arrange the tablet cassettes 12 at high density in a vertical direction.

The rotor 13 is of a columnar configuration, and has the upper surface formed as the conical surface 13*a* protruding toward a center. An axially extending guide groove (not shown) is formed in an outer peripheral surface of the rotor 13, and tablets are stored in an aligned state therein, one on an upper side and one on a lower side. The tablets in the guide groove is vertically separated by the brush portion 21*a* of the partition means 21, and solely the one tablet on the lower side is dropped through the tablet discharge port 19. At the center of the lower surface of the rotor 13, there is integrally provided a rotation shaft, which extends through the through-hole formed in the bottom surface of the rotor accommodating portion 16, with a driven gear 33 being fixed to the protruding portion thereof. The driven gear 33 is in mesh with the first gear 22*a* of the intermediate gear 22. As a result, when the worm gear 23 is rotated, the driven gear 33 and the rotor 13 are rotated through the intermediate gear 22.

Although not shown in detail, in the capping unit 4, a cap supplied from a cap supply portion through a chute is supported by a support arm, and an upper opening portion 73 of the vial 9 downwardly carried by a third carrying means 41 described below is closed, the cap being rotated while pressed by a cap attachment portion to thereby effect capping.

The carrying means 5 includes first, second, third, and fourth carrying means 34, 37, 41, and 52, respectively.

The first carrying means 34 includes, as shown in FIGS. 3 and 10, a sub conveyor 34A and a main conveyor 34B.

The sub conveyor 34A has a structure in which rollers 34*a* are rotatably mounted to both ends of a long support plate 35 having a substantially U-shape section, and two round belts 34*b* are looped around the rollers 34*a* at a predetermined interval. The sub conveyor 34A is disposed on the back of the lifter 8*a* disposed on the back side of each of the buckets 8. On the round belts 34*b*, the vial 9 taken out by the lifter 8*a* is placed in a horizontal position. By rotating the rollers 34*a* by a motor (not shown), the vial 9 placed on the round belts 34*b* is carried to the main conveyor 34B.

The main conveyor 34B has a structure in which, like the sub conveyor 34A, two round belts 35*b* are looped around rollers 35*a*. The main conveyor 34B is disposed below the sub conveyor 34A and transports the vial 9 carried from the sub conveyor 34A toward the take-out unit 6.

On a carrying path by the first carrying means 34 (in this case, a terminal end position of main conveyor 34B), a container size detecting means 100 is disposed. As shown in FIG. 11, the container size detecting means 100 has a structure in which a guide plate 101 mounted to a side surface of the support plate 35 is provided with an arm portion 102 and a sensor 103 for detecting inclination of the arm portion 102.

On a lower side of each of side surfaces of the guide plate 101, tongue members 101*a* are cut to be raised laterally, thereby suppressing contact areas between the vial 9 passing and inner side surfaces (portions left by the cutting and raising) of the guide plate 101. The vial 9 passes through a central position of the guide plate 101 by being guided by the inner side surfaces thereof.

As shown in FIG. 12, to a ceiling surface of the guide plate 101, a holding plate 104 is screwed. To a front end portion of the holding plate 104, the arm portion 102 is rotatably attached with a support shaft 102*a* being a fulcrum. The arm portion 102 has a narrow and long plate shape, and an upper end portion thereof protrudes upwardly of the support shaft to constitute a detection object portion 102*b* detected by the sensor 103. On a lower end side of the arm portion 102, a curved portion 102*c* is formed so as to be smoothly abutted on the outer peripheral surface of the carried vial 9.

Further, the front end portion of the holding plate 104 is provided with an auxiliary plate 105. On the auxiliary plate 105, there is provided a stopper portion 106, to which the detection object portion 102*b* of the arm portion 102 is abutted, for positioning the arm portion 102 in an initial inclination state shown in FIG. 13(*a*). Fixed to both sides of the stopper portion 106 are sensors 103 of a transmission type, each of which includes a light emitting element and a light receiving element. Light from the light emitting element to the light receiving element is interrupted by the detection object portion 102*b* of the arm portion 102, thereby making it possible to specify an outer diameter of the vial 9 from the interrupted light amount (or received light amount) as described below. FIGS. 13(*b*) and 13(*c*) show cases of detecting the vials 9 of two kinds having different outer diameters.

At a destination of the carrying by the first carrying means 34, there is arranged a slidable container support portion 36 for vertically supporting the vial 9 according to its size such that its opening is directed upwardly. The container support portion 36 are composed of support members 36*a* protruding at predetermined intervals, and a distance between the adjacent support members 36*a* is set to a value allowing supporting of flange portions of vials 9 of different sizes.

Container recovery means (in this case, recovery box 107) is disposed on an end portion on the opposite side of a terminal end position of the main conveyor 34B. The recovery box 107 is mainly used for recovering the vial 9 whose size does not match with a size selected based on prescription data as a result of the detection of the size by the container size detecting means 100. Note that, in a case where the carrying of the vial 9 is stopped due to an error or the like, the vial 9 remaining on the carrying path may be recovered in the recovery box 107.

As shown in FIG. 3, the second carrying means 37 is equipped with a pair of holding members 38 for holding and upwardly moving the vial 9 supported by the container support portion 36. The holding members 38 ascend and descend along a vertical rail 38*a*, and are rotatable about a support shaft. The upper end portions of the holding members 38 are urged by a spring (not shown) so that the lower end portions thereof may be separated. Further, a rectangular opening/closing frame member 39 is provided around the lower ends of the holding members 38. The opening/closing frame member 39 is movable between a closed position at which the lower ends of the holding members 38 are brought close to each other against the urging force of the spring 26, and an open position at which they are held in press contact with the inner surface of the vial 9 to hold the same. The opening/closing frame member 39 is moved to the closed position by raising the holding members 38 and causing them to abut a stop portion 40 arranged above the opening/closing frame member 39.

In the second carrying means 37, the holding members 38 are lowered with their lower ends brought close to each other by the opening/closing frame member 39; at the point of time when the holding members 38 enter the vial 9, the opening/closing frame member 39 abut the upper portion of the vial 9. As a result, when the holding members 38 further descend, the guide by the opening/closing frame member 39 is canceled, and the holding members 38 are spread due to the urging force of the spring to thereby hold the vial 9. When the holding members 38 ascend while holding the vial 9, the opening/closing frame member 39 abuts the stop portion 40, and the holding members 38 are forcibly positioned in the closed state, with the holding state for the vial 9 being canceled.

As shown in FIG. 3, the third carrying means 41 is composed of a horizontal movement means 42, an ascent/descent means 43, and a container holding means 44, and carries the tablet cassette 12 mainly between the tablet supply unit 3 and the capping unit 4.

As shown in FIG. 9, the fourth carrying means 52 includes an ascent/descent stand 53 and an arm means 56 provided thereon through the intermediation of a rotating plate 54 and a slide guide 55, and serves to carry the vial 9 mainly between the take-out unit 6 and the capping unit 4.

Between the third carrying means 41 and the fourth carrying means 52, as shown in FIGS. 3 and 4, a standby portion 64 is provided. The standby portion 64 includes container holding members 65 which are provided in one delivery position and in five standby positions.

The standby portion 64 is used to temporarily keep on standby the vial 9 carried by the third carrying means 41 before carrying the vial 9 to the capping unit 4 by the fourth carrying means 52. When being already on standby at the delivery position, a vial 9 is kept on standby by being held by the container holding member 65 at the standby position.

As shown in FIGS. 1 and 2, the take-out unit 6 is equipped with a plurality of take-out ports 61, and has at its center a display 62, with the control device 63 being built in the lower portion thereof.

The control device 63 drive-controls the container supply unit 1, the labeling unit 2, the tablet supply unit 3, the capping unit 4, the carrying means 5, and the take-out unit 6 based on prescription data (what is set forth on the prescription by the doctor, data on the patient, etc.) input from a host computer or the like. Further, the control device 63 specifies the size of the vial 9 based on a detection signal (data related to interrupted light amount or received light amount) obtained by the sensor 103 of the container size detecting means 100, a carrying speed of the main conveyor 34B, or the like, and determines whether or not the vial 9 is the appropriate vial 9. For this determination, a storage portion stores database of correlation between the detection signal (data related to interrupted light amount or received light amount) and the outer diameter of the vial 9. Therefore, when the detection signal from the sensor 103 is input, with reference to the database based on the detection signal, the size can be specified. When it is determined that the vial 9 is of an appropriate size, the vial 9 is carried to the take-out unit 6 as it is. When it is determined to be inappropriate, it is carried to the recovery box 107 to be recovered therein.

Next, the operation of the tablet filling device, constructed as described above, will be illustrated with reference to the flowchart of FIG. 14.

When prescription data is input from the host computer or the like (Step S1) a suitable vial 9 is selected taking into consideration the size and quantity of the corresponding tablets based on the prescription data (Step S2). Then, the selected vial 9 is carried out from the bucket 8 (Step S3). That is, the lifter 8*a* is driven to carry the vial 9 to the first carrying means 34.

In the first carrying means 34, the vial 9 taken out from the bucket 8 by the lifter 8*a* is carried on the sub conveyor 34A. That is, the vial 9 placed in the horizontal position on the round belts 34*b* is carried to the main conveyor 34B. On the main conveyor 34B, the vial 9 is carried toward the take-out unit 6 while being placed in the horizontal position as it is (Step S4).

In the terminal end position of the main conveyor 34B, the vial 9 moves by being carried by the main conveyor 34B, thereby allowing the arm portion 102 to abut on an outer peripheral edge of an end surface of the vial 9, after that, an inclination angle is gradually changed (the inclination angle is gradually increased with respect to a vertical surface). When the curved portion 102*c* of the arm portion 102 slides on the outer peripheral surface of the vial 9, the inclination angle of the arm portion 102 is stabilized. At a time point immediately after the interrupted light amount obtained by the sensor 103 is stable for a predetermined period of time or more, the inclination angle of the arm portion 102 is specified based on the interrupted light amount (Step S5).

Next, based on the specified inclination angle of the arm portion 102, with reference to the database stored in the storage portion, the size of the vial 9 is specified. A comparison is made between the specified size and the size of the vial 9 selected based on the prescription data, thereby determining whether or not the vial 9 is of the appropriate size (Step S6).

When it is determined that the vial 9 is of an inappropriate size, the main conveyor 34B is reversely driven, and the vial 9 is thus recovered in the recovery box 107 (Step S7). As a result, even in a case where the vial 9 different in size from that to be normally stored in the bucket 8 has been erroneously stored therein and the vial 9 of the different size is supplied, it is possible to prevent without fail the vial 9 from being filled with tablets.

When it is determined that the vial 9 is of the appropriate size, the container support portion 36 is slid and kept ready so that the carried vial 9 can be received (Step S8). As a result, the vial 9 is supported in a vertical position at the container support portion 36 so as to be open on the upper side. Subsequently, the container support portion 36 is slid, and a label with a predetermined print is affixed to the outer peripheral surface of the vial 9 by the labeling unit 2 (Step S9). Further, the second carrying means 37 is driven, and the vial 9 is raised while being held (Step S10).

Then, the third carrying means 41 is driven, and the vial 9 raised by the second carrying means 37 is held (Step S11). At this time, in the second carrying means 37, the holding state for the vial 9 is canceled (Step S12). The third carrying means 41 transfers the held vial 9 to the tablet feeder 11 containing the corresponding medicine based on the prescription data (Step S13). Then, the vial 9 is filled with tablets from the tablet feeder 11.

In this embodiment, by detecting the outer diameter of the vial 9 by the container size detecting means 100, the size thereof can be specified. However, it is also possible to more accurately specify the size by also detecting a lengthwise dimension described below.

That is, by the movement of the vial 9, based on a time from a time point when the inclination angle of the arm portion 102 starts to be changed from the initial state to a time point when it returns to the initial state again, and the moving speed of the vial 9, the lengthwise dimension of the vial 9 is calculated. In this case, even when it is determined that the vial 9 is of the inappropriate size, with the structure of the container size detecting means 100, the vial 9 cannot be moved in an opposite direction (to the recovery box 107 side). In this case, it is necessary that a front end portion be extended from the curved portion 102*c* of the arm portion 102 to enable the arm portion 102 to be smoothly retracted by the vial 9 moved in the opposite direction. Note that the arm portion 102 can be moved by another means such as a motor to a position in that the arm portion 102 does not interfere the movement of the vial 9 in the opposite direction. Note that the lengthwise dimension of the vial 9 can be detected by separately providing a sensor or the like.

Further, in this embodiment, the vial 9 is recovered in the recovery box 107. However, the vial 9 may be carried to another recovery position instead of the recovery box 107 by causing a branch from the carrying path. Further, there may be employed a structure in which a retraction position for temporarily retracting the vial 9 (for example, indicated by chain double-dashed line A of FIG. 10) is provided, the size of the vial which is retracted to the retraction position is memorized, and when the vial 9 of this size is demanded, the vial 9 is supplied.

Further, based on the determination by the container size detecting means 100 that the vial 9 supplied is different in size from that to be normally supplied, the vial 9 may be moved back upstream of a supply position of the bucket 8 positioned on a most upstream side. In this case, the size of the vial 9 which is moved back is memorized. When the size of the vial 9 which is moved back matches with the size of the vial 9 to be filled with tablets next, the vial 9 which is moved back is supplied. When the size thereof is different, the vial 9 of a corresponding size may be supplied from the bucket 8. Note that, before the vial 9 which is moved back is supplied, it is determined by the container size detecting means 100 that the size of the vial 9 is different, the vial 9 which has been already moved back in the backward movement is recovered in the recovery box 107. In this case, the size to be memorized is changed to the size of the vial 9 which is newly moved back, to thereby get ready for the next supply of the vial 9. Note that, when an arrangement order of the buckets 8 is set to a decreasing order of the size of the vial 9 contained therein from an upstream side, the vial 9 moved back may be moved slightly upstream of the supply position of the bucket 8 in which the vial 9 of the size moved back is normally stored. Accordingly, a moving distance can be minimum. Note that, in a case where, after the moving back, a size of the vial 9 to be supplied next is larger, the vial 9 has to be moved back again upstream of the position to which the subject vial 9 is supplied.

Further, in this embodiment, the size of the vial 9 is directly detected by the container size detecting means 101. However, the size of the vial 9 may be specified by providing a structure with which the size can be read in a non-contact manner, such as a barcode or a wireless chip to the vial 9 and reading it by reading means. In a case of the barcode, the barcode may be read by the barcode reader from the vial 9 being carried. In a case of the wireless chip, a radio frequency identification system (RFID) may be used. Further, by forming marks such as characters or symbols on the vial 9, changing a color of the vial 9, or changing a shape of a part thereof, a determination can be made by reading the marks, the color, the shape, or the like by a CCD etc. In either case, it suffices that the read data is checked against the database to specify the size of the vial 9.

DESCRIPTION OF SYMBOLS

Figure 1:
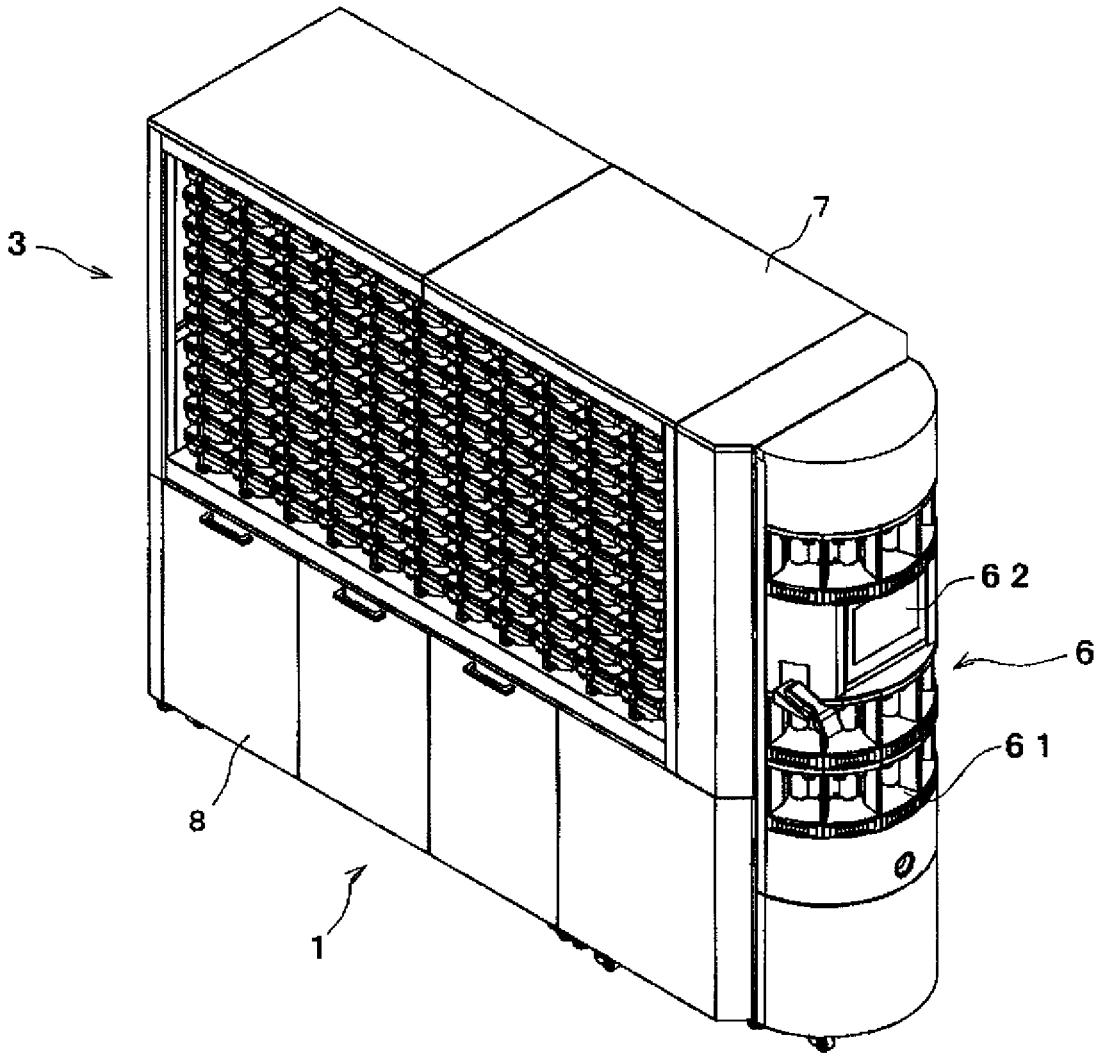
FIG. 1 is a perspective view of a tablet filling device according to this embodiment.
Figure 2:
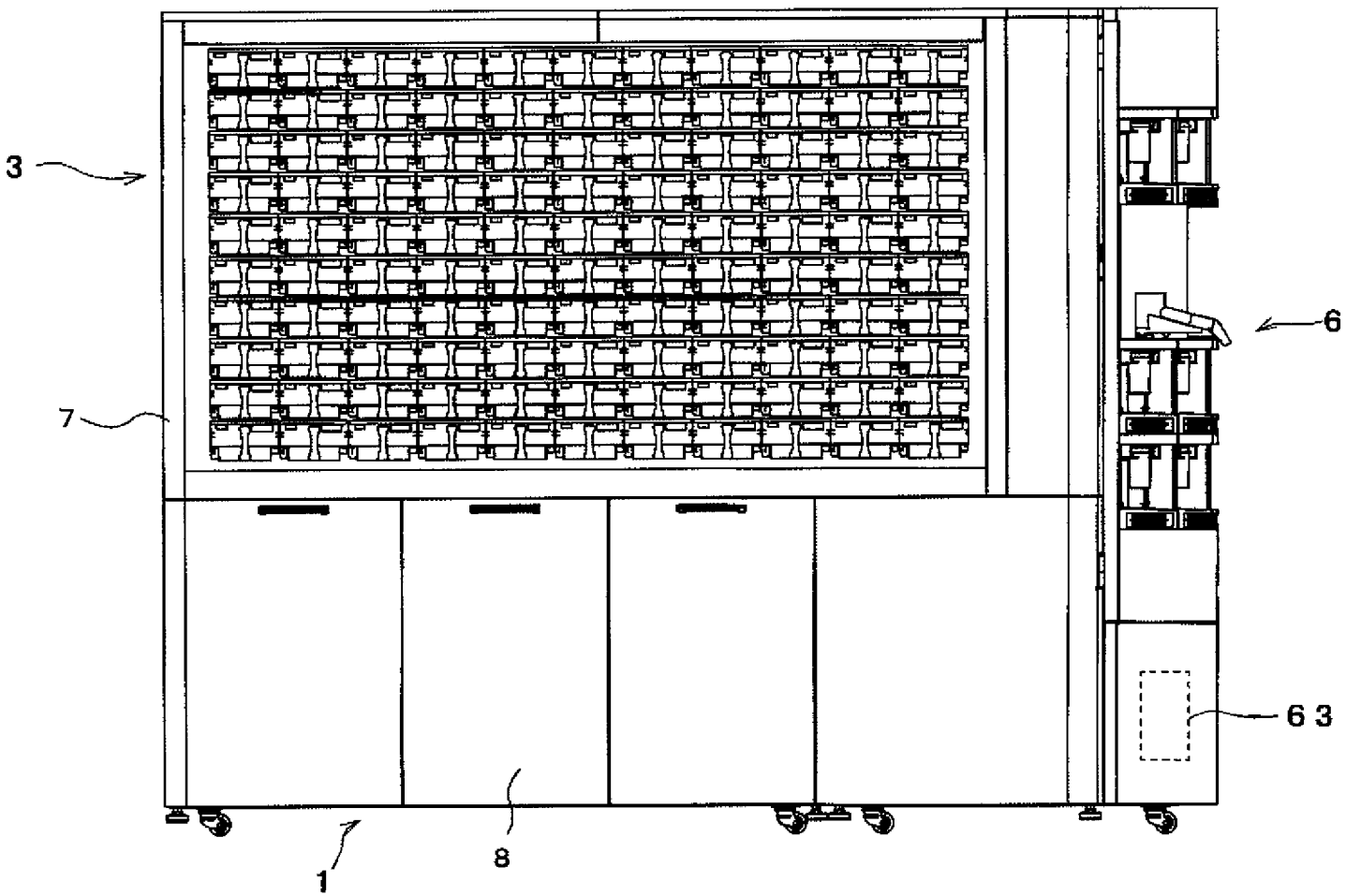
FIG. 2 is a front view of FIG. 1.
Figure 3:
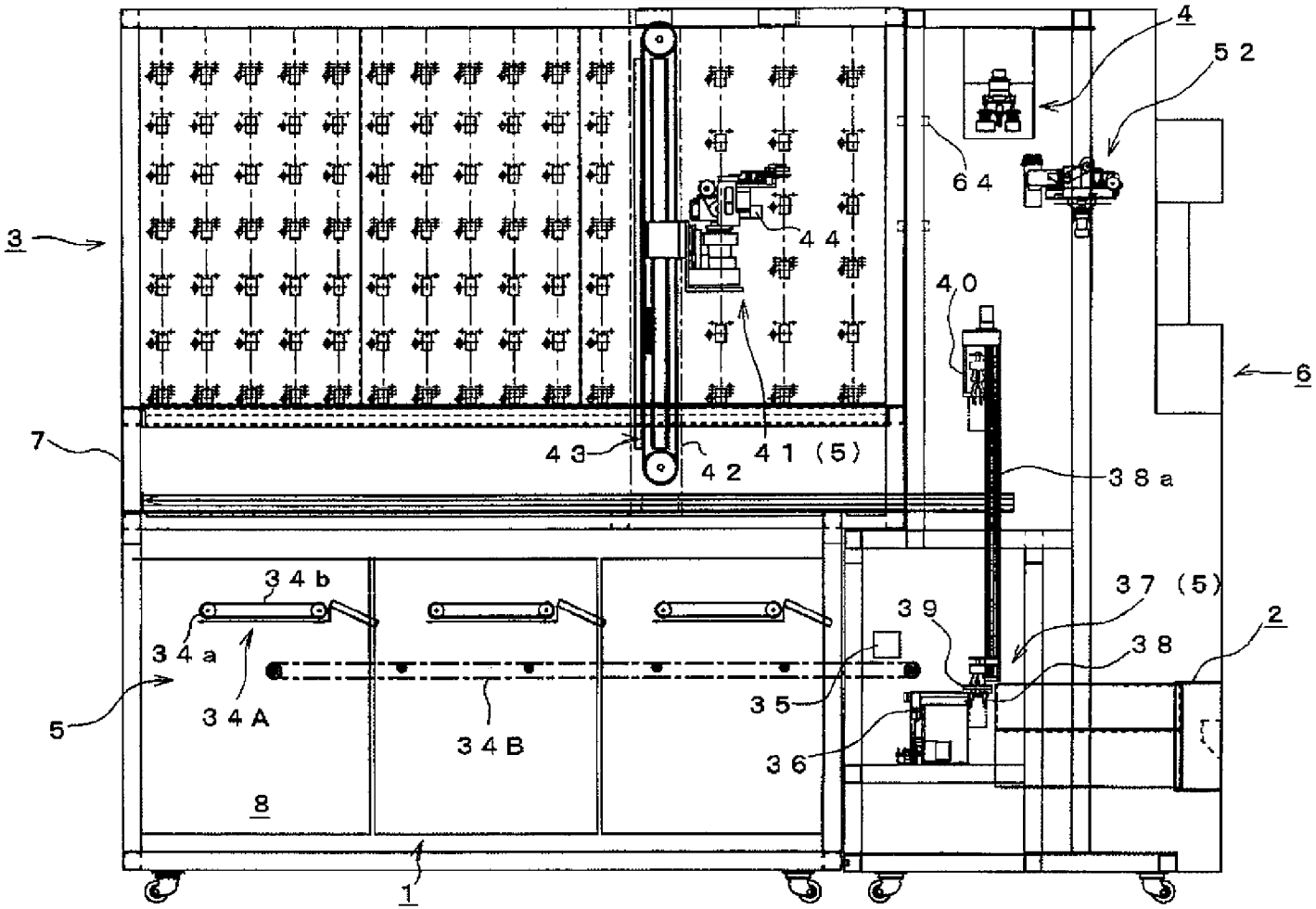
FIG. 3 is a schematic front sectional view of an inner mechanism of FIG. 1.
Figure 4:
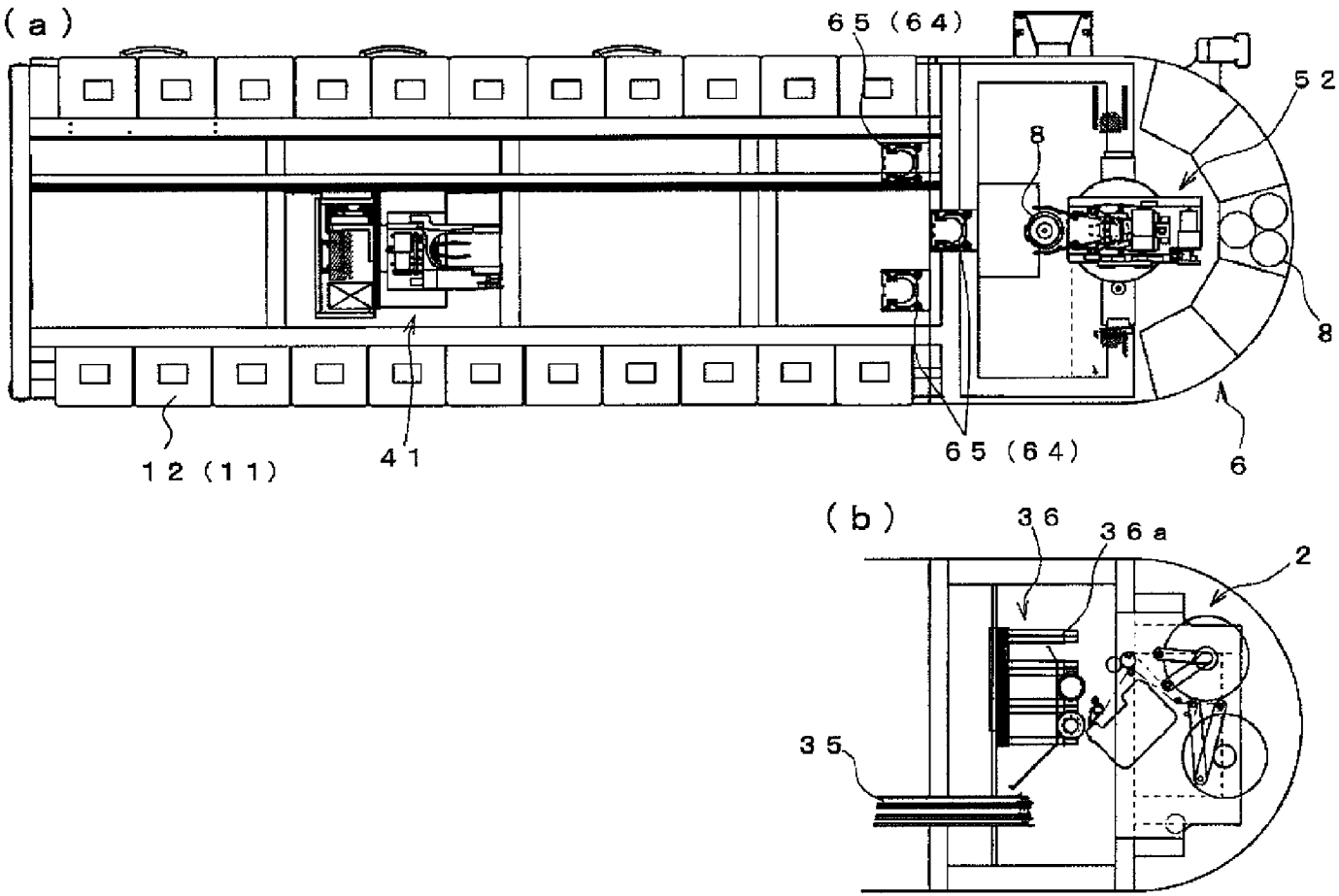
FIG. 4 include FIG. 4(*a*) showing a schematic plane sectional view of the inner mechanism of FIG. 1, and FIG. 4(*b*) showing a partial sectional view thereof.
Figure 5:
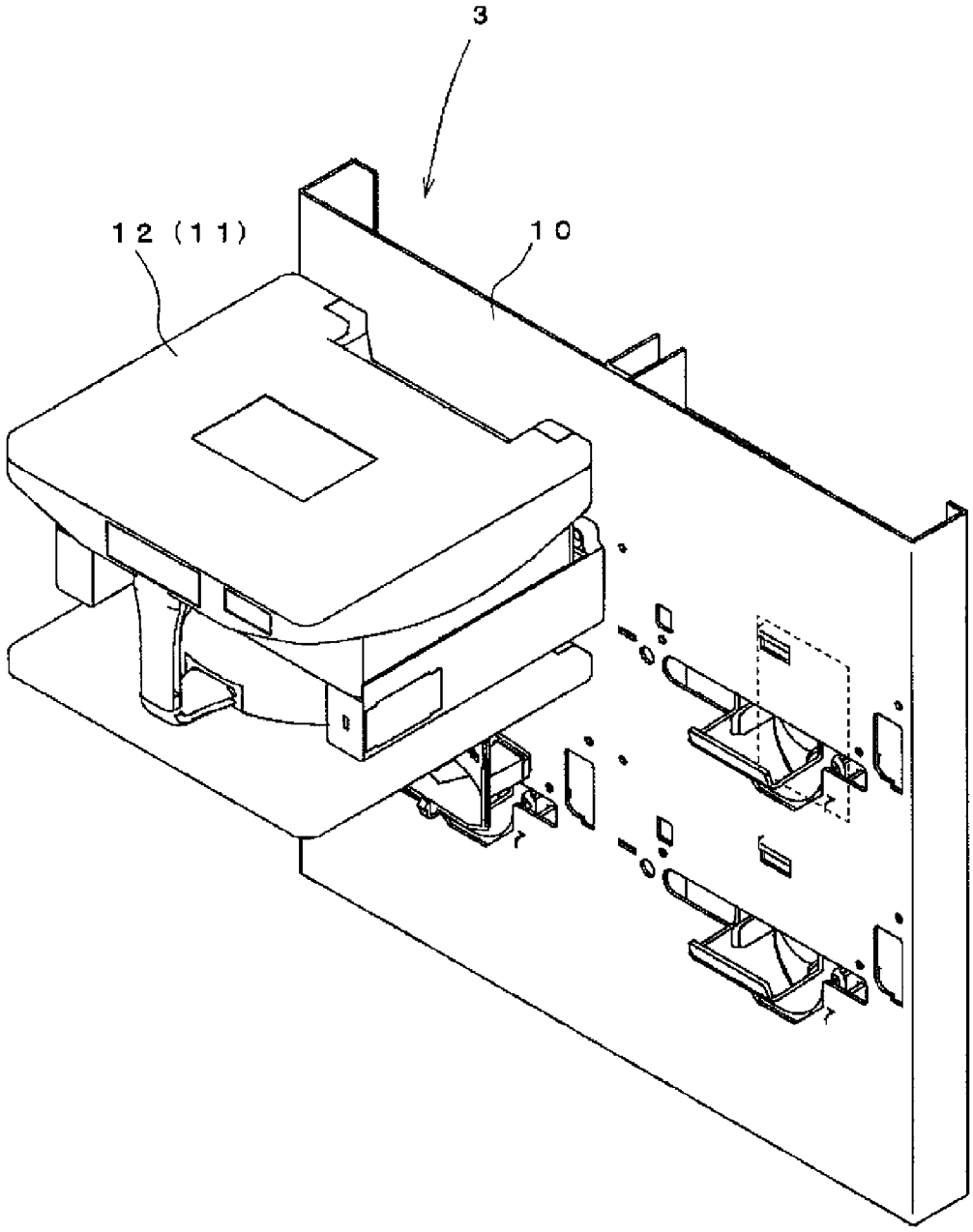
FIG. 5 is a perspective view of a part of a tablet supply unit of FIG. 1.
Figure 6:
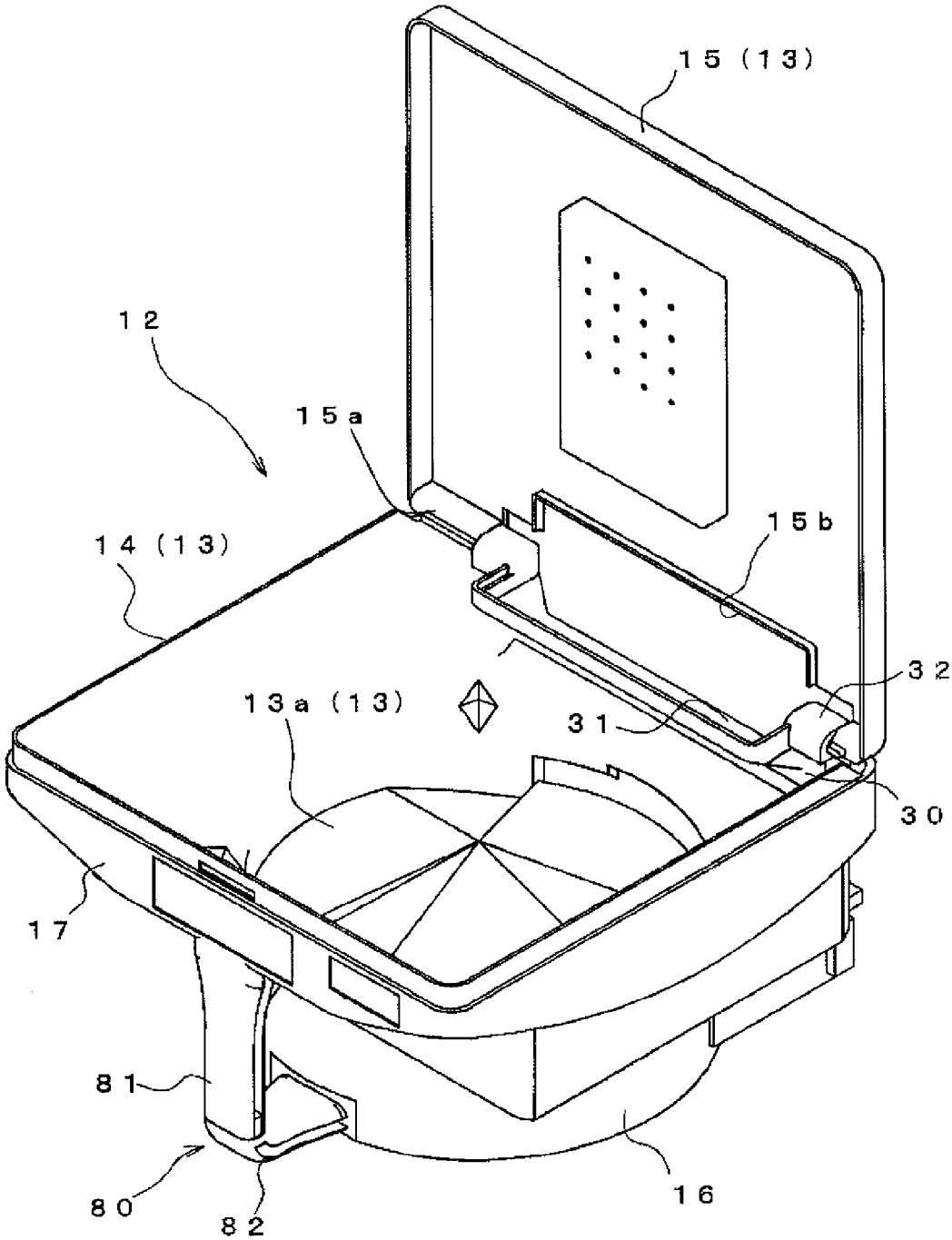
FIG. 6 is a perspective view of a vial of FIG. 5 with its cover member being opened.
Figure 7:
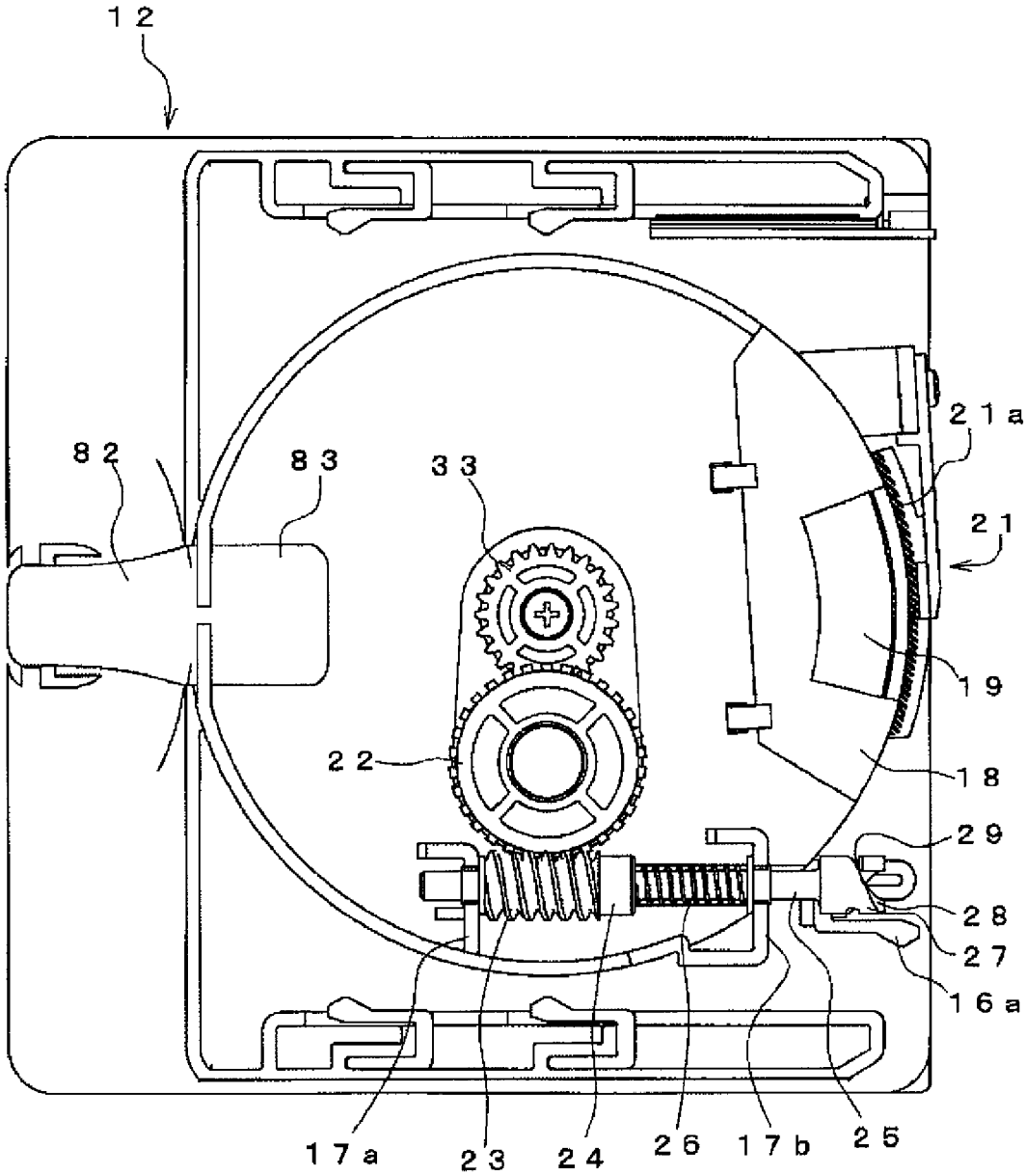
FIG. 7 is a bottom view of the vial shown in FIG. 6.
Figure 8:
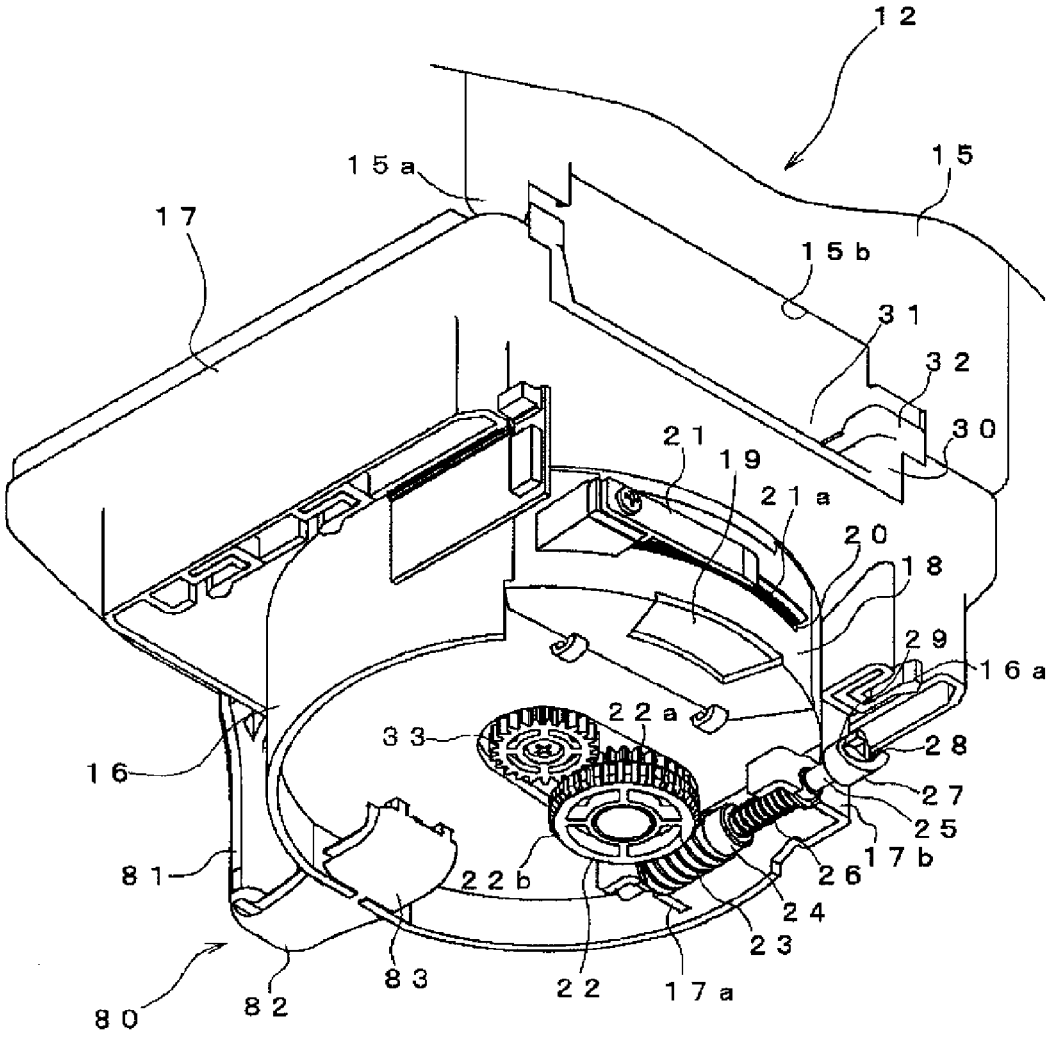
FIG. 8 is a perspective view, as seen from a bottom surface side, of the vial shown in FIG. 6.
Figure 9:
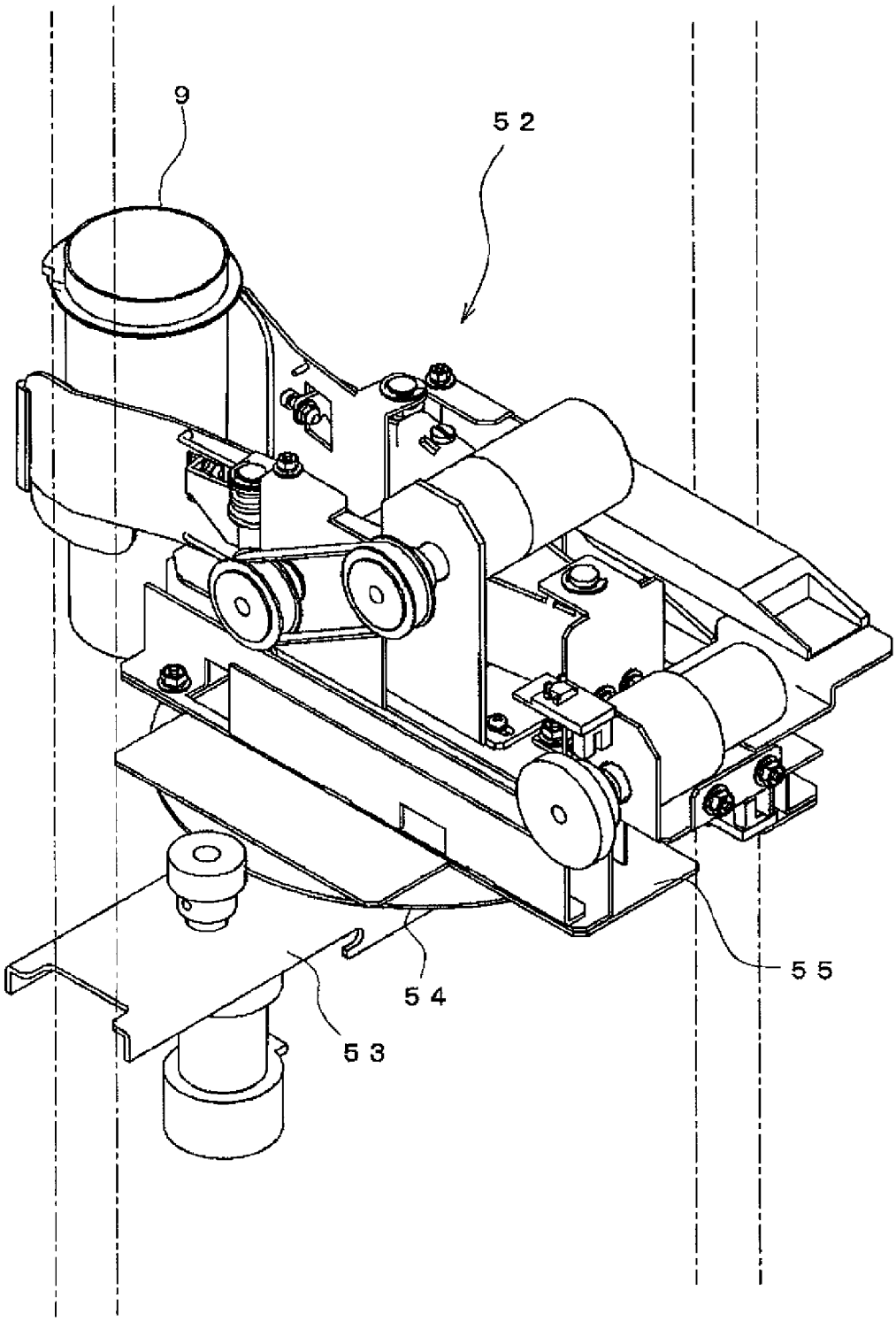
FIG. 9 is a perspective view of a main portion of a fourth carrying means shown in FIG. 1.
Figure 10:
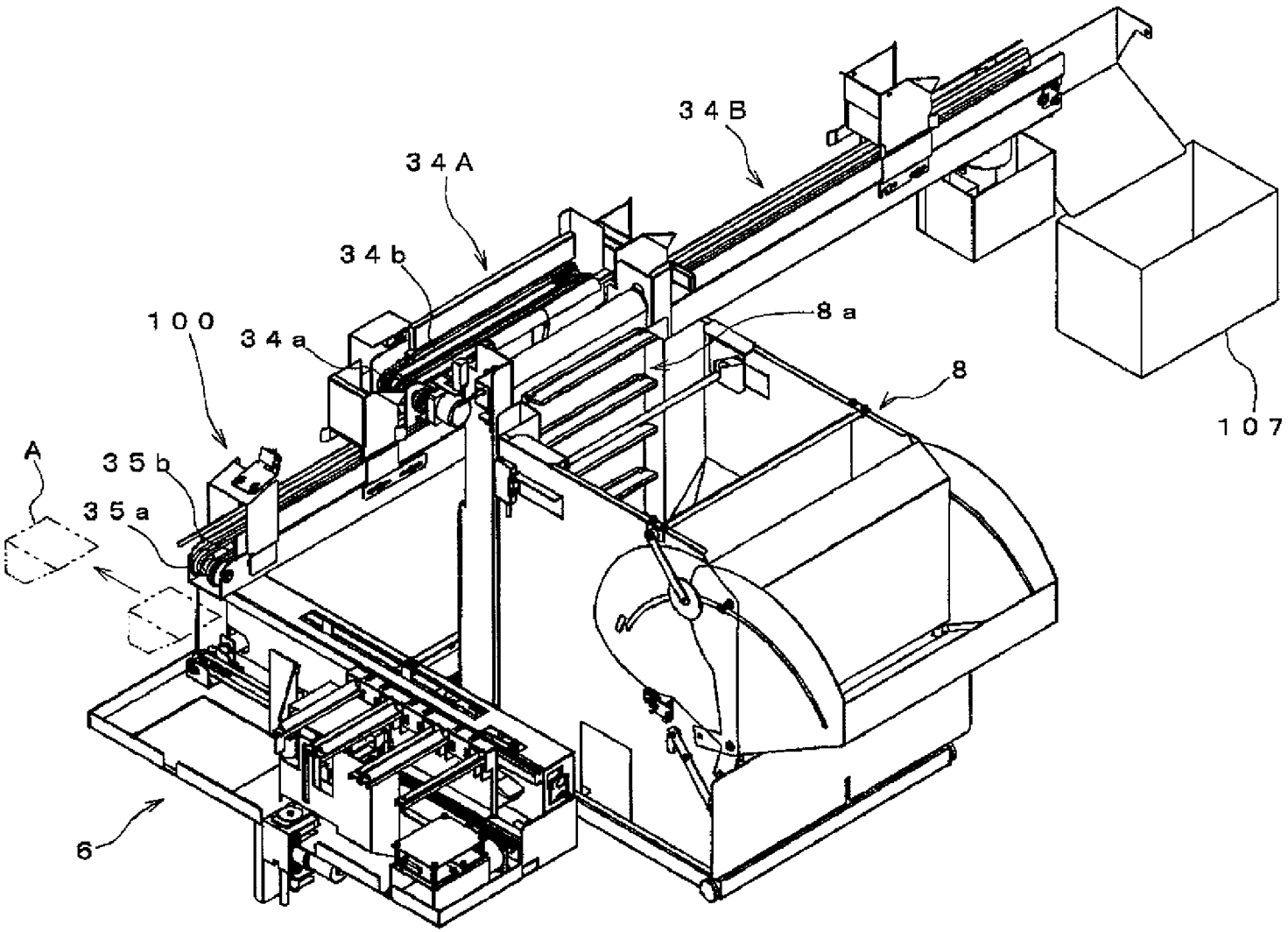
FIG. 10 is a perspective view of a bucket, a first carrying means, and a take-out unit.
Figure 11:
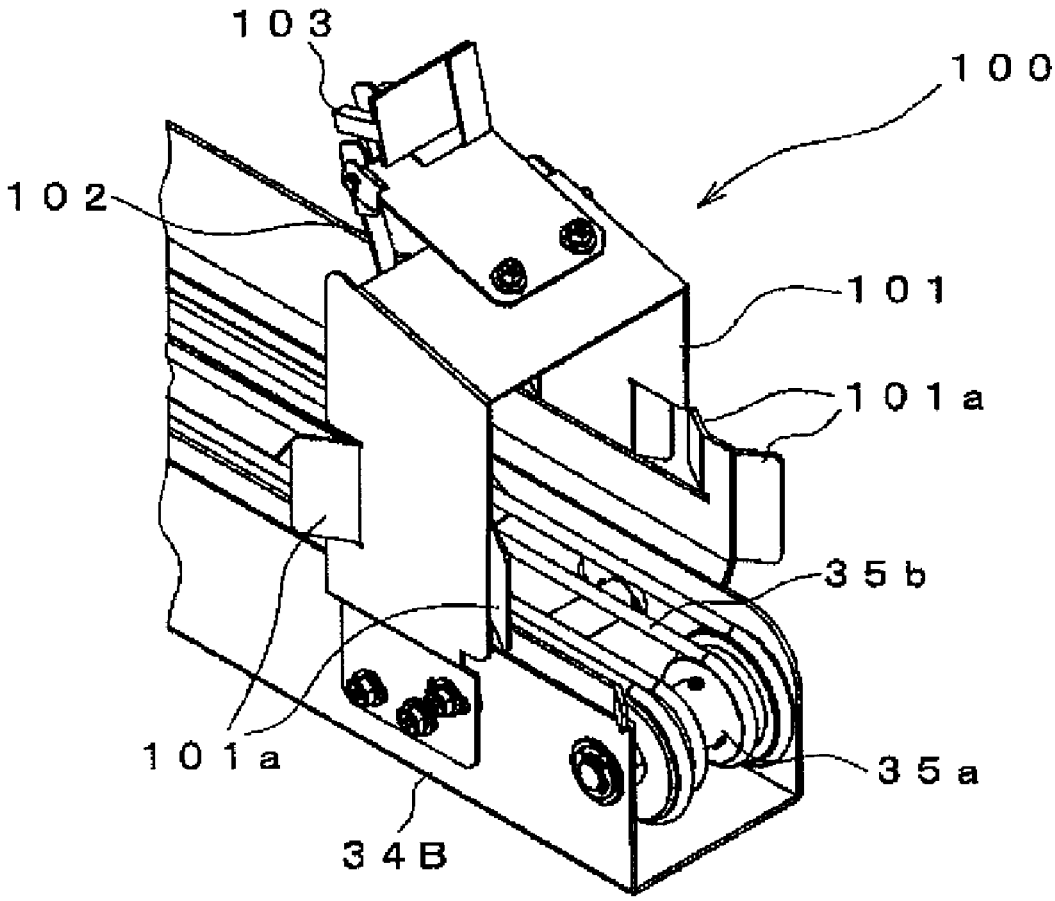
FIG. 11 is an enlarged perspective view of container size detecting means shown in FIG. 10.
Figure 12:
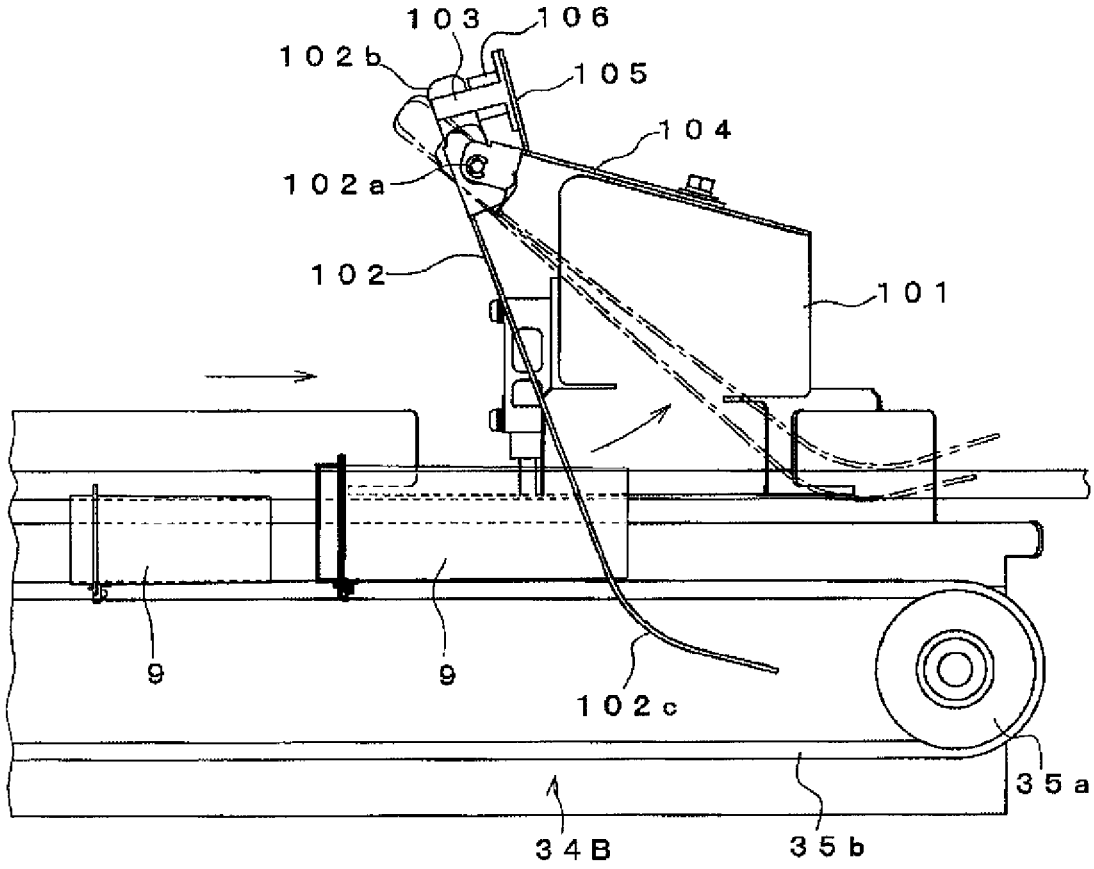
FIG. 12 is a front view of the container size detecting means shown in FIG. 11.
Figure 13:
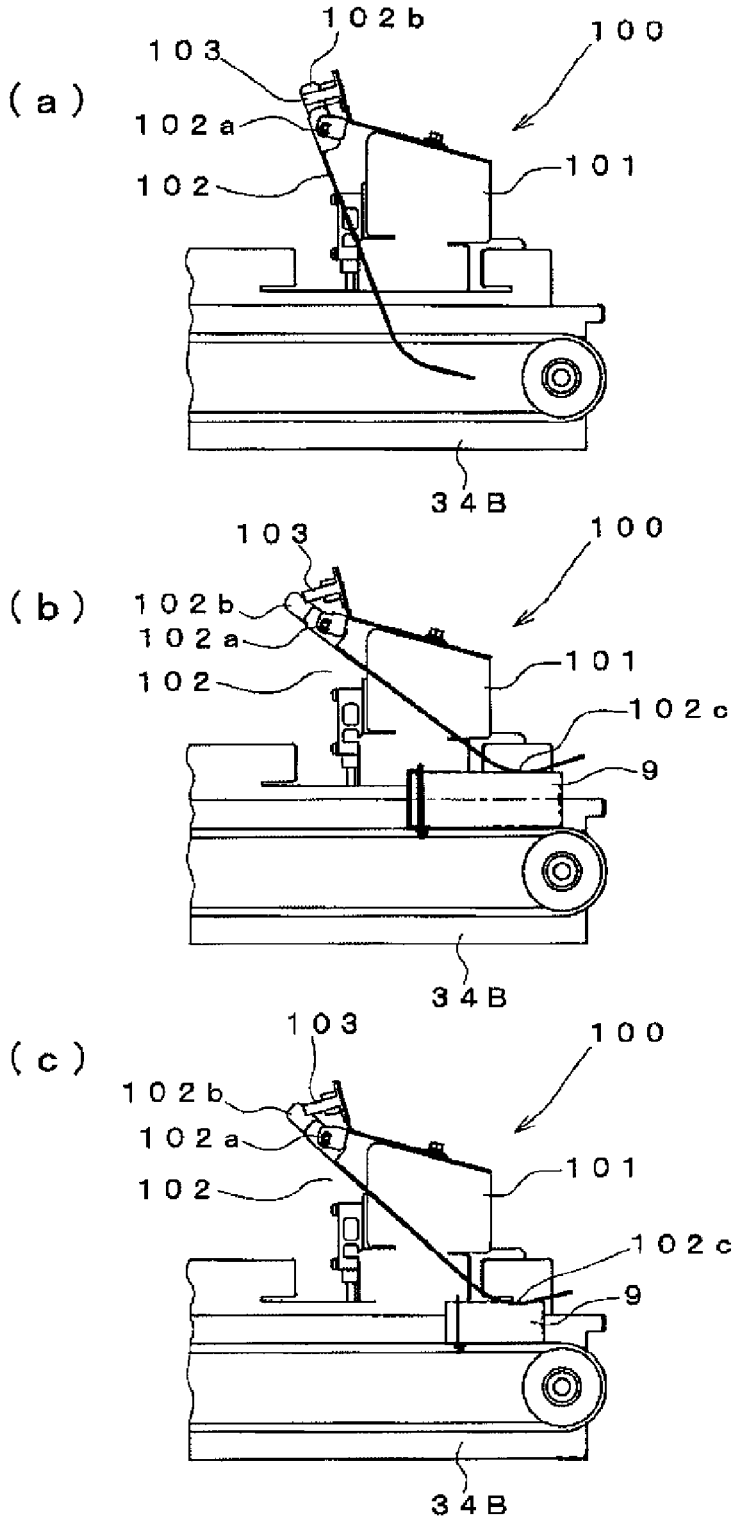
FIG. 13 are views each showing an operating state of the container size detecting means shown in FIG. 12.
Figure 14:
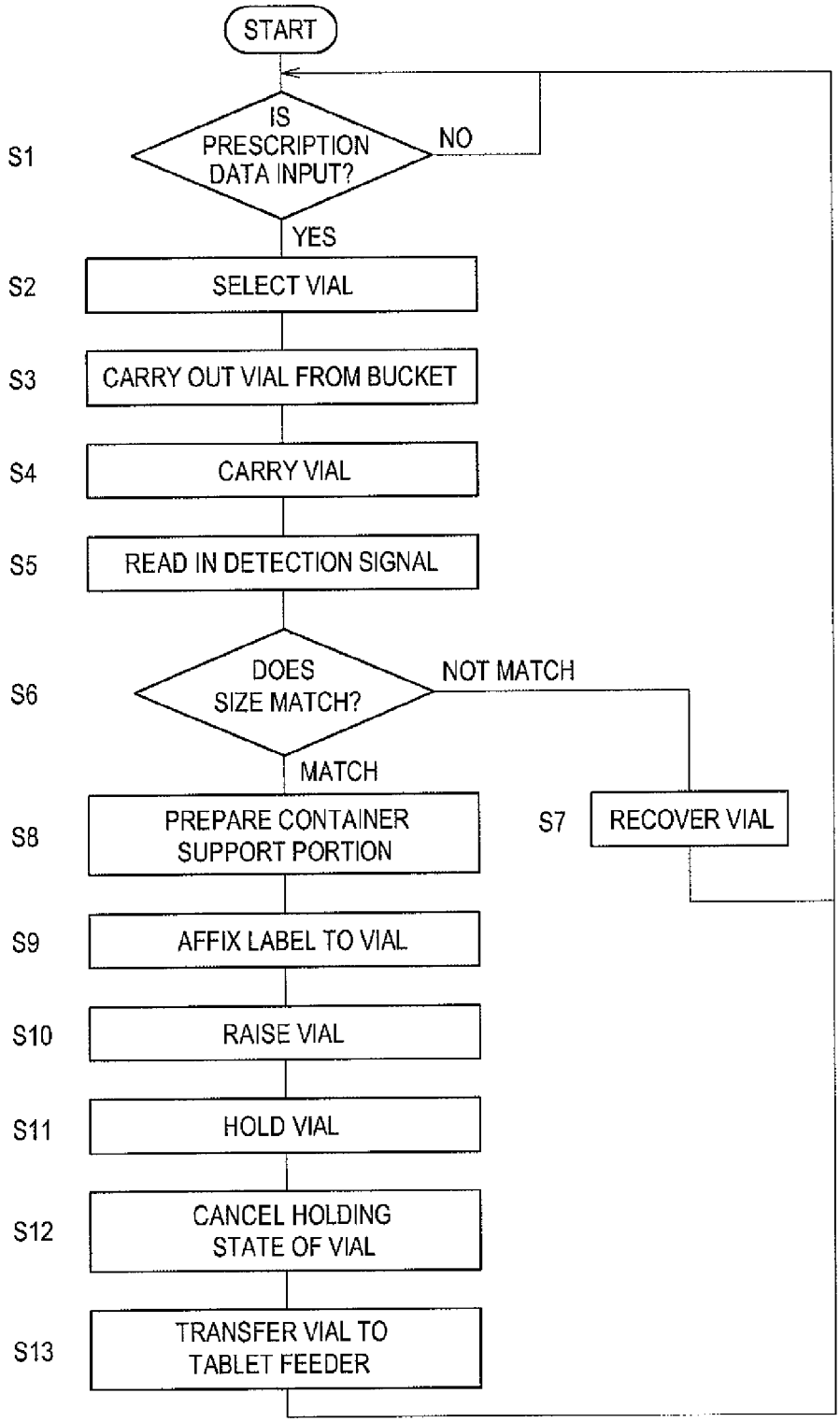
FIG. 14 is a flowchart showing an operation of the tablet filling device according to this embodiment.

1 . . . container supply unit, 2 . . . labeling unit, 3 . . . tablet supply unit, 4 . . . capping unit, 5 . . . carrying means, 6 . . . take-out unit, 7 . . . device main body, 8 . . . bucket, 8*a* . . . lifter, 9 . . . vial (vial), 10 . . . support panel, 11 . . . tablet feeder, 12 . . . tablet cassette, 13 . . . rotor, 13*a* . . . conical surface, 14 . . . cassette main body, 15 . . . cover member, 15*a* . . . shaft portion, 15*b* . . . cutout portion, 16 . . . rotor accommodating portion, 17 . . . tablet storage portion, 17*a*, 17*b* . . . support wall, 18 . . . first replacement piece, 19 . . . tablet discharge port, 20 . . . slit, 21 . . . partition means, 21*a* . . . brush portion, 22 . . . intermediate gear, 23 . . . worm gear, 24 . . . stopper, 25 . . . shaft portion, 26 . . . spring, 27 . . . locking/receiving portion, 28 . . . guide groove, 29 . . . pin holding portion, 30 . . . second replacement piece, 31 . . . recess, 32 . . . bearing portion, 33 . . . driven gear, 34A . . . sub conveyor, 34B . . . main conveyor, 34*a* . . . roller, 34*b* . . . round belt, 35 . . . support plate, 36 . . . container support portion, 36*a* . . . support member, 37 . . . second carrying means, 38 . . . holding member, 38*a* . . . vertical rail, 39 . . . opening/closing frame member, 40 . . . stop portion, 41 . . . third carrying means, 42 . . . horizontal movement means, 43 . . . ascent/descent means, 44 . . . container holding means, 52 . . . fourth carrying means, 53 . . . ascent/descent stand, 54 . . . rotating plate, 55 . . . slide guide, 56 . . . arm means, 61 . . . take-out port, 62 . . . display, 63 . . . control device, 64 . . . standby portion, 65 . . . container holding member, 80 . . . grip, 81 . . . third replacement piece, 82 . . . fourth replacement piece, 83 . . . fifth replacement piece, 100 . . . container size detecting means, 101 . . . guide plate, 101*a* . . . tongue member, 102 . . . arm portion, 102*a* . . . support shaft, 102*b* . . . detection object portion, 102*c* . . . curved portion, 103 . . . sensor, 104 . . . holding plate, 105 . . . auxiliary plate, 106 . . . stopper portion, 107 . . . recovery box.

The invention claimed is:

1. A tablet filling device, comprising:

a plurality of container storage means for storing vials based on vial sizes;

container take-out means for taking out a vial of a size selected based on prescription data from a corresponding one of the plurality of container storage means;

carrying means for carrying the vial taken out by the container take-out means;

tablet supplying means for supplying a tablet to the vial carried by the carrying means;

container recovery means for recovering the vial carried by the carrying means;

container size detecting means provided to a carrying path by the carrying means for detecting a size of the vial carried by the carrying means, the container size detecting means including:

an arm portion rotatable about a support shaft, the arm portion adapted to contact an outer peripheral portion of the vial carried by the carrying means, and a sensor adapted to detect an inclination of the arm portion that results from contact with the outer peripheral portion of the vial; and control means for determining whether the size of the vial selected based on the prescription data matches a size of the vial detected by the container size detecting means, for allowing the tablet to be supplied to the vial by the tablet supplying means when the sizes match each other, and for allowing the vial to be carried and kept on standby by the retraction means when the sizes do not match each other, wherein the carrying means carries the vial in a horizontal position, wherein the control means is adapted to determine the size of the vial based on the inclination detected by the sensor.

2. A tablet filling device according to claim 1, wherein:

the vial has a bottomed cylindrical shape; and the container size detecting means can detect an outer diameter of the vial.

3. A tablet filling device according to claim 2, wherein the container size detecting means can also detect a lengthwise dimension of the vial.

* * * * *